United States Patent [19]

Wolfson et al.

[11] Patent Number: 5,014,022

[45] Date of Patent: May 7, 1991

[54] SWITCHED-LOOP/180 DEGREE PHASE BIT WITH APERTURE SHUTTER CAPABILITIES

[75] Inventors: Ronald I. Wolfson, Los Angeles; Clifton Quan, Arcadia, both of Calif.

[73] Assignee: Hughes Aircraft Company, Los Angeles, Calif.

[21] Appl. No.: 450,131

[22] Filed: Dec. 13, 1989

[51] Int. Cl.[5] ..... H01P 1/18; H01P 1/185

[52] U.S. Cl. ..... 333/161; 333/156; 333/164

[58] Field of Search ..... 333/161, 164, 156, 109, 333/116, 117, 120–122, 101, 103, 104

[56] References Cited

U.S. PATENT DOCUMENTS 3,803,621 4/1974 Britt ..... 333/164 X
4,070,639 1/1978 Nemit et al. ..... 333/161
4,305,052 12/1981 Baril et al. ..... 333/161 X
4,496,918 1/1985 Thorpe ..... 333/161 X

OTHER PUBLICATIONS

Davis, "Integrated Diode Phase-Shifter Elements for an X-Band Phased-Array Antenna", IEEE Trans. on Microwave Theory & Tech. Dec. 1975, pp. 1080–1084.

*Primary Examiner*—Eugene R. LaRoche
*Assistant Examiner*—Seung Ham
*Attorney, Agent, or Firm*—Leonard A. Alkov; Wanda K. Denson-Low

[57] ABSTRACT

A switched loop/180° phase shift device is disclosed, having the additional capability of an aperture shutter that can be selected to produce either a noncorrelated reflection in one mode of operation, or to absorb RF energy that enters the radiating aperture port in the other mode.

16 Claims, 2 Drawing Sheets

SWITCHED-LOOP/180 DEGREE PHASE BIT WITH APERTURE SHUTTER CAPABILITIES

BACKGROUND OF THE INVENTION

The present invention relates to microwave phase shifter devices, and more particularly to 180° phase shift devices having the further capability of a solid-state aperture shutter that can be selected to produce either a reflection of uniform amplitude and phase in one mode of operation, or to absorb RF energy that enters the radiating aperture in the other mode.

Devices are known in the art which provide the function of a selectable 180° phase shift transition. For example, U.S. Pat. No. 4,070,639 describes a 180° microwave phase-bit device implemented in a stripline medium with integral coupling into a waveguide by means of an H plane loop within the waveguide. PIN-diode switches are employed to reverse the direction of current in the loop.

Another microwave phase shifter device is described in "Integrated Diode Phase-Shifter Elements for an X-Band Phased-Array Antenna," Mark E. Davis, IEEE Transactions on Microwave Theory and Techniques, December, 1975, pages 1080–1084. A 180° phase bit device is described which employs PIN diodes to selectively reverse the direction of current flow in a ring hybrid to achieve reversal of the RF phase.

Radar systems engineers are paying increased attention to aperture designs that allow substantial reductions in the radar cross section (RCS) of airborne platforms. Another concern is potential damage to delicate electronics in or immediately behind the radiating elements due to directed or stray high-level RF radiation as, for example, on the flight deck of an aircraft carrier.

A major disadvantage of the prior art devices is that it does not incorporate the significant features of protection from high-level RF energy and low reflected signal levels at a uniform phase angle.

SUMMARY OF THE INVENTION

A microwave device is disclosed for coupling microwave energy between the device and a first transmission medium, the device providing a 180 degree selective phase bit function as well as energy reflection and absorption functions. The device is characterized by a phase shifter port, a conductive loop extending orthogonally to a coupling region in the first transmission medium and being coupled to the phase shifter port, and an aperture port, wherein the device couples microwave energy between the phase shifter port and the aperture port. Preferably, the phase shifter port is coupled to the conductive loop by a magic T coupler, the phase shifter port connected to the coupler sum port and the loop being connected between the coupler output ports. In the preferred embodiment, the difference port of the coupler is connected via a conductor line to a matched load termination.

The device further comprises means operable in a first device mode for establishing a first direction of current in the conductive loop for coupling energy between the respective ports with a reference phase shift. The device also includes means operable in a second device mode for establishing a second direction of current in the loop which is reverse to the first direction for coupling energy between the respective ports with a phase shift 180 degrees out-of-phase with the reference phase. These respective means include first and second diode switches for selectively shorting the loop to ground at two locations. In the preferred embodiment, the shorting locations are symmetrically located about the coupling region at one-half wavelength spacings. The shorting locations are also located at a one-half wavelength spacing from the coupler output ports. In the first mode, the first switch is open circuited, and the second switch is short circuited; in the second mode, the switch positions are reversed.

In accordance with the invention, the device includes means operable in a third device mode for shorting the conductive loop adjacent the coupling region so as to reflect incident microwave energy on said aperture port or said phase shifter port. This means includes in the preferred embodiment the shorting circuitry of the first and second device switches in this mode.

The device further includes means operable in a fourth device mode for absorbing RF energy incident on the aperture port from the transmission media in the load.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
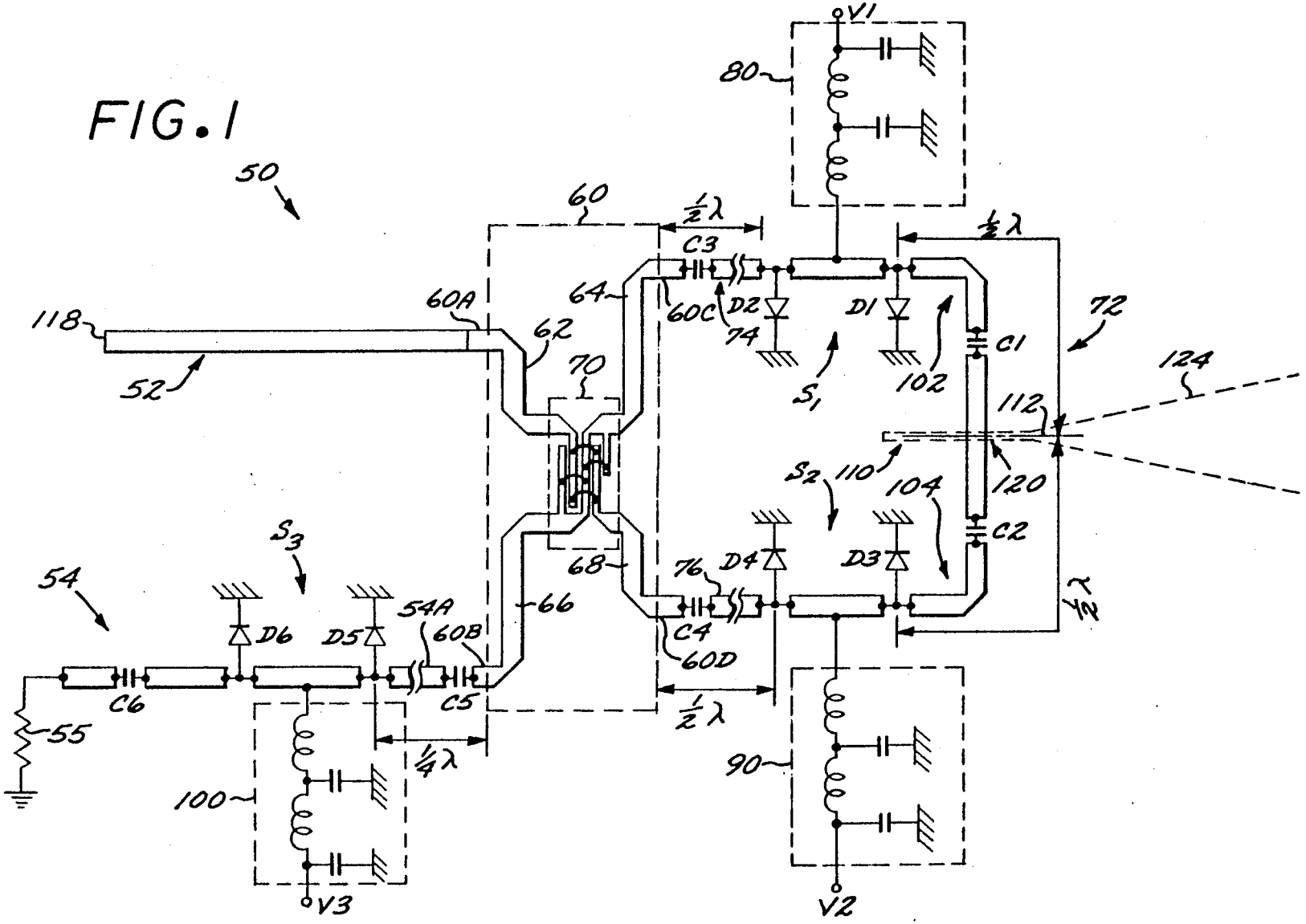
FIG. 1 is a circuit schematic of a 180° phase bit device with a selective aperture shutter capability in accordance with the invention.

Referring now to FIG. 1, a circuit schematic of a 180° phase bit device 50 having an aperture shutter capability in accordance with the invention is disclosed. The device employs a four port coupler, in its preferred embodiment a magic T coupler, which couples the phase shifter input signal to a PIN-diode switched conductive loop. A fourth port of the coupler is connected through a diode switch to a matched load. The circuit device is arranged such that it can be operated in four modes, the first two for transferred input energy at either a 0° (relative) phase or 180° phase, a third mode wherein energy incident on the device aperture port is reflected, and a fourth mode wherein energy incident on the device aperture port is absorbed in the load.

The device 50 comprises an input conductive line 52 which connects to the sum port 60A of the magic T coupler 60. The output ports 60C and 60D of the coupler 60 are connected to a conductive loop indicated generally by reference number 72. Diode switches S1 and S2 selectively short conductor elements 74 and/or 76 to ground. Conductive line 54 is coupled to the difference port 60B of the magic T coupler, and is terminated in a matched load 55. A third diode switch S3 selectively shorts the line 54 to ground.

The effective electrical length of the conductor segment 74 between the diode switch S1 and the adjacent coupler output port 60C is one-half wavelength of the center band frequency. Similarly, the effective electrical length of the conductor segment 76 between the diode switch S2 and the coupler output port 60D is onehalf wavelength, and the effective electrical length of the conductor segment 54A between the diode switch S3 and the coupler difference port 60B is one-quarter wavelength. (It will be appreciated that FIG. 1 is not drawn to scale.)

The diode switch S1 comprises two PIN diodes D1 and D2, which are biased by biasing circuit 80. A potential V1 is selectively applied to the biasing network 80 to bias the diodes D1 and D2 in the conductive state. Similarly, the diode switch S2 comprises PIN diodes D3 and D4, which are biased by biasing circuit 90. A potential V2 is selectively applied to the biasing network 90 to bias the diodes D3 and D4 in the conductive state. The diode switches S1 and S2 each comprise two PIN diodes to provide better isolation when the diodes are biased in the conductive state, and to make the circuit physically larger so that the coupling region 110 is completely surrounded by the loop 72. The switches S1, S2 and S3 may alternately each comprise a single PIN diode or more than two diodes.

The third diode switch S3 also comprises two PIN diodes D5 and D6, which are biased by the biasing circuit 100. A potential V3 is selectively applied to the biasing network 100 to bias the diodes D3 and D4 in the conductive state.

PIN diode switches and biasing networks are well known in the art, and provide a means for selectively grounding the conductive lines at a particular conductor location. Thus, by application of a forward biasing voltage V1, V2 or V3 to the respective biasing circuit 80, 90 or 100, the diodes of the respective switch S1, S2 or S3 can be forward biased to the conductive state, thereby shorting the circuit conductor at the switch point connection. If the biasing voltage is removed, then the respective diodes of the switch will not be forward biased to the conductive state, and will instead be in the nonconductive state, thereby open circuiting the switch.

The magic T coupler 60 is a device well known in the microwave arts. A magic T coupler has the characteristic that a signal input at its sum port will be divided between the two output ports with equal amplitude and in phase relative to one another, while being isolated from the difference port. Signals presented to the output ports of the coupler which are equal in amplitude and are in phase relative to one another will be summed and presented at the sum port of the coupler; if the signals are equal in amplitude and are 180 degrees out-of-phase relative to one another, they will be summed and presented at the difference port of the coupler; if the signals are neither equal in amplitude nor in phase, the incident energy will be divided between the sum and difference ports in a ratio determined by the vector summation of the signals.

In the disclosed embodiment, the magic T coupler 60 comprises a 90 degree line coupler 70; line couplers are well known in the art. The magic T function is achieved by connecting one output port of the coupler 70 to a length of conductor 64 which has an effective electrical length which is one-quarter wavelength longer than the conductor 68 connected to the second output port of the coupler 70; the conductor 66 connected to the difference port is also one-quarter wavelength longer than the conductor 62 connected to the sum port of the coupler 70.

The device 50 further comprises a plurality of capacitors C1–C6 disposed in the conductor loop 72 and line 54 which function to block dc signals from the respective biasing circuits 80, 90 and 100. It will be appreciated that the circuit 50 may be fabricated in various circuit media, including microstripline and stripline.

The midpoint 112 of the conductive loop 72 is located at a spacing of one-half wavelength of the center frequency of the band of interest from the respective switches S1 and S2.

The device 50 is employed to couple energy via a coupling region 110 to an aperture which may, for example, include a flared notch radiator 124 as illustrated in FIG. 1. Thus, in a general sense, the device 50 may be considered to comprise a phase shifter port 118 and an aperture port 120. The conductor loop 72 extends generally orthogonally to the coupling region 110 in the vicinity of the coupling region.

The device 50 provides the capability of a 180° degree phase bit device as in the prior art discussed above, but further provides the function of a selectable aperture shutter for selectively absorbing or reflecting incident RF radiation on the aperture port. These functions are provided in four different modes of operation.

Table I summarizes the four modes of operation, which are selected by appropriately setting the PIN-diode switches S1–S3.

TABLE I

SUMMARY OF FOUR MODES OF OPERATION

| MODE | SWITCH #1 | SWITCH #2 | SWITCH #3 | COMMENTS |
|---|---|---|---|---|
| 1 | Open CKT. | Short CKT. | Short CKT. | Reference Phase Mode |
| 2 | Short CKT. | Open CKT. | Short CKT. | 180° Phase Shift |
| 3 | Short CKT. | Short CKT. | Open CKT. | Reflective Shutter |
| 4 | Open CKT. | Open CKT. | Open CKT. | Absorptive Shutter |

A brief explanation of each mode of operation is given below:

Mode 1—Reference Phase Mode

With switch S3 short-circuited, the fourth port with matched load termination is effectively out of the circuit. Switch S3 is electrically separated by an odd number of quarter-wavelengths from both switches S1 and S2, and therefore appears as an open circuit to each. Switch S2, which is also short-circuited, forms the end of a clockwise loop that starts at switch S1, which is open-circuited. This loop couples the RF signal reciprocally between the phase-shifter port 118 and the aperture port 120. The coupling region 110 is excited by an RF signal having a reference phase.

Mode 2—180° Degree Phase Shift Mode

The device operation is the same as for mode S1, except that switches S1 and S2 are respectively biased in the opposite sense, and the loop is effectively reversed. This reverses the direction of current exciting the coupling region 110, so that 180° phase shift (as compared to the reference phase mode) is obtained.

Mode 3—Reflective Shutter State

With switches S1 and S2 short-circuited, the loop 72 is shorted out and there is no transfer of RF signals between the phase-shifter port 118 and the aperture port 120. Further, RF signals entering aperture port 120 will be reflected back at a phase angle that depends only on the characteristics of aperture port 120, of short-circuited switches S1 and S2 and of the conductors loop to the right of the switches. This effectively isolates the aperture port 120 from any circuitry connected to the phase shifter port 118 that might result in large reflections correlated in amplitude and phase. The reflective shutter will work with switch S3 either short or open-circuited; however, with the switch S3 open-circuited, any RF signal that leaks past the S1 and S2 shorts will be absorbed in the matched load termination.

MODE 4

With all three switches S1-S3 open-circuited, both ends of the loop 72 are connected to the magic T coupler 60. RF signals entering the aperture port 120 will excite the upper and lower halves of the loop with equal amplitude, but because of the reversal of the exciting currents in the top and bottom of the coupling region 110, the two signals will be 180 degrees out-of-phase. Because of this phase relationship, the signals will not be passed to the phase-shifter port 118 but will instead be absorbed in the matched load termination 55.

The invention can be implemented using a multitude of other combinations of radiating elements, transmission media, coupling mechanisms and PIN-diode switches. Three examples of particular interest are shown in FIG. 2-7.

Figure 2:
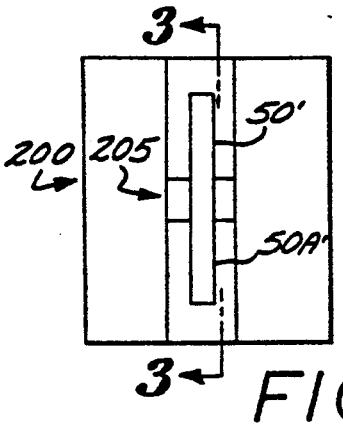
FIGS. 2 and 3 illustrate the configuration of a device as in FIG. 1 employed in a flared waveguide structure.
Figure 3:
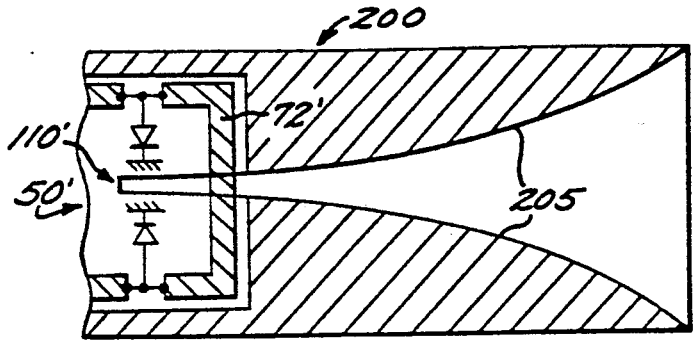

FIGS. 2 and 3 illustrate an embodiment wherein a device as described with respect to FIG. 1 is employed to excite a flared ridge waveguide 200. FIG. 2 is an end view of the waveguide 200, showing the flared ridge 205. A device 50′ as described with respect to FIG. 1 is constructed on a stripline comprising a dielectric sheet 50A′, and is disposed along the center line of the waveguide ridge 205, e.g., through a slot formed in the waveguide 200 top wall and ridge 205. FIG. 3 is a partial cross-sectional view taken along line 3—3 of FIG. 2, and generally illustrates the waveguide ridge 205 and a portion of the coupling loop 72′ and PIN diode switches comprising the device 50′. Here the coupling region 110′ is adjacent the narrow juncture of the sides of the flared ridge 205. The loop 72′ excites the region 110′, in the manner as discussed with respect to FIG. 1. It will be appreciated by those skilled in the art that an array of waveguide radiating elements each comprising a flared ridge waveguide structure 200 and circuit device 50′ may be formed.

Figure 4:
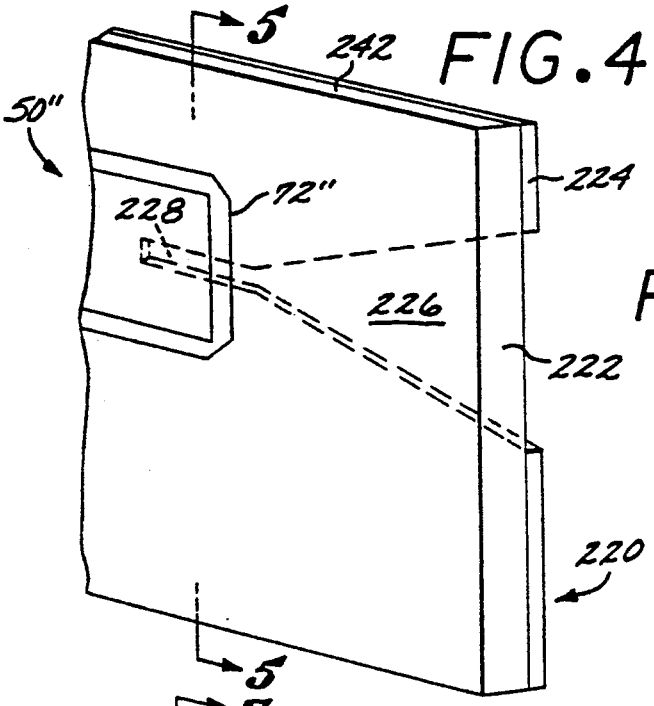
FIGS. 4 and 5 illustrate the configuration of a device as in FIG. 1 employed in a microstripline structure.
Figure 5:
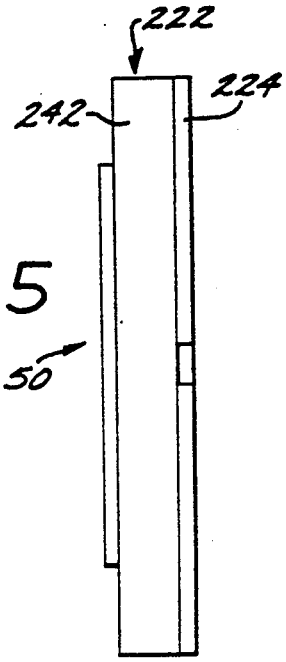

FIGS. 4 and 5 illustrate an embodiment of a radiating element 220 formed in microstripline and excited by a device 50″ as described with respect to FIG. 1. The microstripline element comprises a dielectric substrate 222, typically formed of a material having a dielectric coefficient of between about 2.5 to 10. A conductive layer 224 typically of copper is formed on one surface of the dielectric substrate 222. The layer 224 has a flared area 226 formed wherein there is no conductive layer. The flared area 224 terminates in a notch area 228. The device 50″ is formed on the opposite side of the dielectric substrate 222, and its conductive lines and the coupler are formed by conductor lines formed on the substrate in the conventional manner of fabricating microwave circuits on microstripline. The coupling loop 72″ encircles the coupling region defined by the notch 228. FIG. 5 is a partial cross-sectional view of the element 220 taken along line 5—5 of FIG. 4, and illustrates the conductor layer 224 and the conductor layer defining the loop 72″ on opposite sides of the substrate 222.

Figure 6:
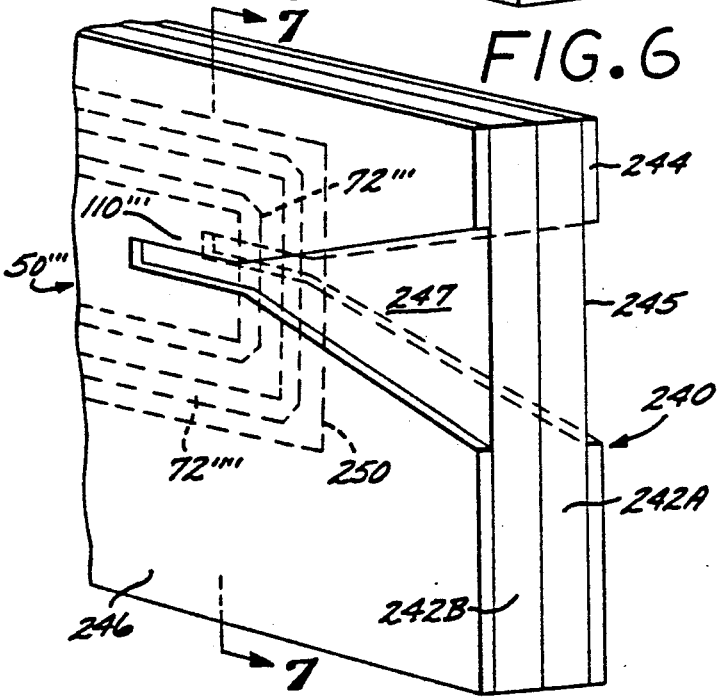
FIGS. 6 and 7 illustrates the configuration of a devices as in FIG. 1 employed in a stripline structure.
Figure 7:
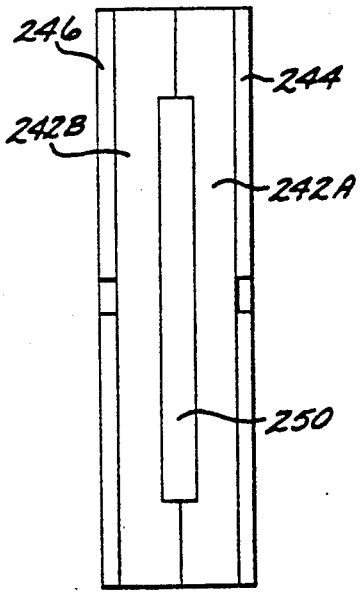

FIGS. 6 and 7 illustrate a flared-notch stripline radiating element 240 fabricated in double layered stripline and employing a device 50‴ as described with respect to FIG. 1 to excite the radiating element. The element 240 comprises two dielectric substrates 242A and 242B formed of a material having a dielectric constant preferably in the range of 2.0 to 2.5. Conductive layers 244 and 246 are formed on exterior sides of the substrates 242A and 242B, and having matching flared notches 245 and 247 formed therein; the flared notches narrow down to form a coupling region 110‴ to which the device 50‴ couples energy. The device 50‴ is formed on a stripline substrate 250 sandwiched between the substrate layers 242A and 242B, as illustrated in the cross-sectional view of FIG. 7. The device 50‴ includes mirror image conductor loops 72‴ and 72⁗ formed on opposite sides of the interior substrate 250, so that mirror images of the circuit 50 are formed one each side of the substrate 250.

The embodiments of FIGS. 2-7 are merely examples of the possible types of microwave circuits which may be fed from a device 50 as shown in FIG. 1. Thus, the device can be used to directly feed radiation elements or as a coupling mechanism into waveguide.

Combination of a 180° phase bit function with a reflective and absorptive mode functions in a single device leads to the advantages of reduced parts count, lower cost, smaller size and weight, greater reliability, lower insertion loss and reduced VSWR. Moreover, the invention provides protection from high-level RF radiation (reflective mode), reflection of incident RF radiation with uniform amplitude and phase (reflective mode), and low aperture radar cross-section (RCS) (absorptive mode). Incident RF energy on the aperture of a radar system can enter via the radiators and pass through the phase shifters and into the feed networks typically connected to the phase shifters. A multitude of reflections, correlated in amplitude and phase, can then be reradiated from the aperture to form a well-defined beam, which could be readily observed. When the system employs the phase shift device embodying the invention, however, and the phase shift device is operated in the reflective mode, incident energy is reflected by the diode switches and cannot reach the feed networks. The phase angle of these reflections is determined only by the design parameters of the aperture port, the loop coupler and the diode switches. The reflection is specular in nature and can therefore be treated for low observability more easily than the focused reflection from the feeds. In a conventional scanning aperture, reflections also occur directly off of the aperture components. The largest contributions are usually from the radiating elements and the phase shifters. The first tend to be uniform and are therefore specular, while the second are random and create a "fuzzball." As noted previously, the specular reflections are relatively easy to handle. The "fuzz-ball" is dealt with by trying to minimize both the magnitude and the randomness of the phase-shifter reflections. The invention accomplishes this in the absorptive mode because most of the inband energy that is incident on the aperture is absorbed rather than reflected. Furthermore, the phase of the reflections from the diode switches is more uniform than from the phase shifter, which has a multitude of phase states, each with a different reflection phase.

It is understood that the above-described embodiments are merely illustrative of the possible specific embodiments which may represent principles of the present invention. Other arrangements may readily be devised in accordance with these principles by those skilled in the art without departing from the scope of the invention.

What is claimed is:

1. A microwave device for coupling microwave energy between the device and a first transmission medium, the device providing a 180 degree selective phase bit function as well as energy reflection and absorption functions, and comprising:

a phase sifter port;

a conductive loop extending generally orthogonally to a coupling region in a first transmission medium and being coupled to said phase shifter port;

said device further being characterized by an aperture port, wherein said device coupled microwave energy between said phase shifter port and said aperture port;

means operable in a first device mode for establishing a first direction of current in said loop for coupling energy between said phase shifter port and said aperture port with a reference phase shift;

means operable in a second device mode for establishing a second direction of current in said loop which is reverse to the first direction for coupling energy between said phase shifter port and said aperture port with a phase shift substantially 180 degrees out-of-phase with said reference phase;

means operable in a third device mode for shorting said conductive loop adjacent said coupling region so as to reflect incident microwave energy incident on said aperture port from either said transmission medium or said phase shifter port;

means operable in a fourth device mode for absorbing microwave energy incident on the aperture port from said transmission medium in a load; and means for selecting said first, second, third or fourth device operating mode.

2. The device of claim 1 further characterized in that said device is fabricated in a microstripline transmission medium.

3. The device of claim 1 further characterized in that said device is fabricated in a stripline transmission medium.

4. The device of claim 1 wherein said first transmission medium comprises a stripline transmission line.

5. The device of claim 1 wherein said first transmission medium comprises a microstripline transmission line.

6. The microwave device of claim 1 further characterized by first and second diode switches arranged to selectively short the conductive loop at locations spaced from said coupling region, the diode switches characterized by a conductive state and a nonconductive state, and wherein the means for selecting the first and second device operating modes comprises means for controlling the states of the first and second switches so that one switch is n the conductive mode and the other switch is in the nonconductive mode.

7. The microwave device of claim 6 further characterized by a third diode switch arranged to selectively short said load, whereby said mode selecting means comprises means for placing said first, second and third diode switches in the nonconductive mode to select said fourth mode.

8. The microwave device of claim 6 wherein said mode selecting means comprises means for placing said first and second diode switches in the conductive state to select said third mode.

9. A microwave frequency device for coupling RF energy between the device and a first transmission medium, the device operable in four modes, to respectively couple RF energy from a phase shifter input port to an aperture port with a reference phase shift or with a phase shift which is 180 degrees out-of-phase with the reference phase, or to reflect energy incident on the aperture port or to absorb energy incident on said aperture port from external to the device, comprising:

a four port magic T coupler device, having respective sum, difference and first and second output ports;

said phase shifter port coupled to said sum port of said coupler by a first length of conductive line;

a conductive loop extending orthogonally to a coupling region in said transmission medium, and having first and second ends, the first end thereof coupled to said first output port of said coupler, and the second end thereof coupled to said second output port of said coupler, said loop characterized by a loop midpoint at said aperture port adjacent said coupling region, a first selective shorting means disposed at a point on said loop which is one-half wavelength away from said midpoint, a second selective shorting means disposed at a point on said loop which is one-half wavelength away from said midpoint and on the opposite side of said first shorting means;

a matched load coupled to said difference port of said coupler by a second length of conductive line;

a third shorting means for selectively shorting said second conductive line at a point between said difference port and said matched load;

whereby said device may be operated in a first mode when said first shorting means is open circuited, and said second and third shorting means are short circuited, such that the second shorting means forms the end of a clockwise loop commencing at the first shorting means, thereby coupling the RF signal incident through the phase shifter port to the aperture port with a reference phase shift and the matched load is effectively out of the circuit, in a second mode when said first and third shorting means are short circuited and said second shorting means is open circuited, whereby the operation is effectively the same as the first mode except the current flow through the loop which excites the aperture port is reversed, thereby providing a phase shift which is 180 degrees out-of-phase with the reference phase, in a third mode wherein the first and second shorting means are shorted, thereby reflecting any RF energy incident on the aperture port, and in a fourth mode wherein the first, second and third shorting means are open circuited, whereby energy incident on the transmission medium port from the transmission medium is absorbed in said load.

10. The device of claim 9 wherein each said respective first, second and third shorting means comprises a PIN diode switch and a biasing network for selectively biasing the diode to either the conductive or nonconductive state.

11. A microwave device for coupling microwave energy between the device and a first transmission medium, the device providing a 180 degree selective phase bit function as well as energy reflection and absorption functions, and comprising:

a phase shifter port;

a conductive loop extending generally orthogonally to a coupling region in a first transmission medium and being coupled to said phase shifter port;

said device further being characterized by an aperture port, wherein said device couples microwave energy between said phase shifter port and said aperture port;

means operable in a first device mode for establishing a first direction of current in said loop for coupling energy between said phase shifter port and said aperture port with a reference phase shift;

means operable in a second device mode for establishing a second direction of current in said loop which is reverse to the first direction for coupling energy between said phase shifter port and said aperture port with a phase shift substantially 180 degrees out-of-phase with said reference phase;

means operable in a third device mode for shorting said conductive loop adjacent said coupling region so as to reflect microwave energy incident on said aperture port from either said transmission medium or said phase shifter port;

means operable in a fourth device mode for absorbing microwave energy incident on the aperture port from said transmission medium in a load;

means for selecting said first, second, third or fourth device operating mode; and a magic T coupler for coupling said phase shifter port to said conductive loop, the magic T coupler including a sum port, a difference port, and first and second output ports, said phase shifter port connected to the sum port of the coupler, and the conductive loop characterized by first and second ends, each connected to one of said coupler output ports, and wherein said load is connected to the difference port via a length of conductive line.

12. The device of claim 11 further comprising first and second diode switches and first and second biasing means for selectively biasing said respective switches to either the conductive or nonconductive state, the first switch connected between the first output port and the coupling region, and the second switch connected between the second output port and the coupling region, and wherein and first switch is biased in the nonconductive state and said second switch is biased in the conductive state during said first mode, and during the second mode the first switch is biased in the conductive state and the second switch is biased in the nonconductive state.

13. The device of claim 11 wherein said first diode switch is disposed to short the conductive loop at a point located about one-half wavelength from the coupling region, and the second diode switch is disposed to short the conductive loop at a point located about one-half wavelength from the coupling region.

14. The device of claim 11 further comprising a diode switch disposed to selectively short the conductive line connecting the load and the difference port, at a point disposed about one-quarter wavelength from the difference port, and wherein said diode switch is shorted during said first and second modes to effectively remove the load from the device circuit during these modes.

15. A microwave device for coupling microwave energy between the device and a waveguide, the device providing a 180 degree selective phase bit function as well as energy reflection and absorption functions, and comprising:

a phase shifter port;

a conductive loop extending generally orthogonally to a coupling region in a waveguide transmission medium and being coupled to said phase shifter port;

said device further being characterized by an aperture port, wherein said device couples microwave energy between said phase shifter port and said aperture port;

means operable in a first device mode for establishing a first direction of current in said loop for coupling energy between said phase shifter port and said aperture port with a reference phase shift;

means operable in a second device mode for establishing a second direction of current in said loop which is reverse to the first direction for coupling energy between said phase shifter port and said aperture port with a phase shift substantially 180 degrees out-of-phase with said reference phase;

means operable in a third device mode for shorting said conductive loop adjacent said coupling region so as to reflect microwave energy incident on said aperture port from either said waveguide or said phase shifter port;

means operable in a fourth device mode for absorbing microwave energy incident on the aperture port from said waveguide in a load; and means for selecting said first, second, third or fourth device operating mode.

16. The device of claim 15 wherein said waveguide includes an internal flared ridge which tapers to a narrow region, and wherein said coupling region is adjacent said narrow region of said flared ridge.

* * * * *